US005669138A

United States Patent [19]

Wetzel

[11] Patent Number: 5,669,138

[45] Date of Patent: Sep. 23, 1997

[54] SHAVING HEAD FOR ELECTRIC RAZORS

[75] Inventor: Matthias Wetzel, Frankfurt, Germany

[73] Assignee: Braun Aktiengesellschaft, Kronberg, Germany

[21] Appl. No.: 525,536

[22] PCT Filed: Mar. 4, 1994

[86] PCT No.: PCT/EP94/00652

§ 371 Date: Sep. 15, 1995

§ 102(e) Date: Sep. 15, 1995

[87] PCT Pub. No.: WO94/23913

PCT Pub. Date: Oct. 27, 1994

[30] Foreign Application Priority Data

Apr. 13, 1993 [DE] Germany ..... 43 12 060.1

[51] Int. Cl.[6] ..... B26B 19/02; B26B 19/14

[52] U.S. Cl. ..... 30/43.92; 30/43.6

[58] Field of Search ..... 30/43, 43.91, 43.92, 30/43.6

[56] References Cited

U.S. PATENT DOCUMENTS

| | | | |
|---|---|---|---|
| 1,833,954 | 12/1931 | Schick | 30/43.92 |
| 2,181,038 | 11/1939 | Wimberger . | |
| 2,281,841 | 5/1942 | Holsclaw | 30/43.92 |
| 2,284,038 | 5/1942 | Bruecker | 30/43 |
| 2,423,177 | 7/1947 | Cunliffe | 30/43.92 |
| 2,629,169 | 2/1953 | Kleinman | 30/43.92 |
| 2,787,829 | 4/1957 | Bayne | 30/43.92 |
| 4,081,902 | 4/1978 | Locke | 30/43.92 |

FOREIGN PATENT DOCUMENTS

| | | |
|---|---|---|
| 602640 | 4/1929 | Germany . |
| 635108 | 9/1936 | Germany . |
| 821 010 | 9/1951 | Germany . |
| 11 11 062 | 7/1961 | Germany . |
| 1 553 660 | 5/1971 | Germany . |
| 2234356 | 1/1974 | Germany . |
| 23 47 587 | 5/1981 | Germany . |
| 82 27 546 | 3/1983 | Germany . |
| 62-246 396 | 10/1987 | Japan . |
| 521 709 | 5/1940 | United Kingdom . |
| 13 67 445 | 9/1974 | United Kingdom . |

*Primary Examiner*—Hwei-Siu Payer
*Attorney, Agent, or Firm*—Fish & Richardson, P.C.

[57] ABSTRACT

The invention is directed to a dry shaving apparatus, with at least one shaving head comprised of an outer cutter and an inner cutter, whereof the outer cutter which includes an engaging surface is formed by a wall element having slots and bridge members, and by at least one further wall element disposed in an angled relationship to the first wall element, wherein a hair feeder provided on the wall element forming the engaging surface is arranged to project beyond the outer contour of the angled wall element.

15 Claims, 7 Drawing Sheets

SHAVING HEAD FOR ELECTRIC RAZORS

This invention relates to a dry shaving apparatus, with at least one shaving head comprised of an outer cutter and an inner cutter, whereof the outer cutter which includes an engaging surface is formed by a wall element having slots and bridge members, and by at least one further wall element disposed in an angled relationship to the first wall element, with hair-feeding means being provided on the wall element forming the engaging surface, and which hair-feeding means are configured in the manner of bridge members and having ends projecting freely relative to the angled wall element.

A dry shaving apparatus of the type initially referred to is known from German Utility Model DE-GM 82 27 546. The outer cutter of the shaving head is comprised of a foil screen member combined with a comb-type shearing member. Provided in the comb-type shearing member are slots forming cutting ledges and reaching as far as into the angled side wall of the comb-type shearing member at the end remote from the foil screen member, with at least two adjacent slots in the angled side wall forming a common opening. In the bridge members merging with the angled side wall and the bridge members terminating in advance of the angled side wall, a cutting ledge is ground for cooperation with the inner cutter of the comb-type shearing member.

From DE-AS 1 111 062 a dry shaving apparatus is known having a shaving head comprised of a foil screen member combined with a comb-type shearing member. The comb-type shearing member includes two shearing surfaces separated by a U-shaped recess. The shearing surfaces include slots forming cutting ledges that reach as far as into the angled outer wall elements carrying the shearing surfaces, with four adjacent slots in the angled side wall forming a common opening.

From U.S. Pat. No. 2,181,038 a dry shaving apparatus is known whose shaving head is formed of an essentially U-shaped shear plate and a triangular inner cutter operatively associated therewith. For the purpose of providing cutting elements, the shear plate provides in its planar engaging surface round holes as well as slots extending transversely to the longitudinal extent of the shear plate into the wall elements arranged at an angle to the shear plate, and the bridge members in the two transition areas from the planar engaging surface to the two angled wall elements are bulged in an arched fashion to avoid sharp edges.

From GB 1 367 445 a dry shaving apparatus is known having two parallel short-hair cutter units and one long-hair cutter unit arranged therebetween in a vertically adjustable manner. The long-hair cutter unit is of a T-shaped configuration, including two rows of sharp-edged teeth extending parallel to the short-hair cutter units and composed each of a cutting comb and a cutting blade in order to be able to utilize this long-hair cutter unit also for trimming purposes—see FIG. 12.

SUMMARY OF THE INVENTION

It is an object of the present invention to improve the shaving head of a dry shaving apparatus of the type initially referred to such as to ensure optimum feeding of hairs into the cutting area formed by outer and inner cutter, while at the same time preventing irritation to the skin.

According to the present invention, this object is accomplished in that the freely projecting ends protrude beyond the outer contour of the angled wall element and lie in the plane of the wall element forming the engaging surface. An essential advantage afforded by the present invention is that the freely projecting ends of the bridge-type hair-feeding means produce an outer cutter with a comb structure which is arranged in advance of the cutting area and whose freely projecting comb ends perform a combing function, thus providing an optimum method of catching the hairs to be shaved and feeding them into the cutting area formed by outer and inner cutter. As the shaving head is moved across the skin surface, the hair-feeding means arranged in advance of the cutting area are able to catch not only hair that rests flat against the skin, but also hair that extends from the skin in an entangled manner, feeding it into the cutting area.

In a further feature of the present invention, the hair-feeding means are formed by a tangential extension of the bridge members forming the engaging surface of the outer cutter. Accordingly, the hair-feeding means form a component part of the material from which the outer cutter is made. The outer cutters of the present invention are manufactured applying stamping and pressing methods, whereby a U- or a cup-shaped form is obtained, producing at the same time the bridge members of the outer cutter, which bridge members provide the hair-feeding means as well as the cutting ledges. The manufacture of the hair-feeding means thus requires no additional expenditure of material and time.

An optimum guided entry of hairs is obtainable according to the invention in that, for the purpose of providing hair-feeding means, all of the bridge members of the wall element forming the engaging surface are extended so as to protrude beyond the contour of the wall element arranged in an angled relationship thereto.

In an embodiment of the present invention enhancing the stability of the outer cutter, selected bridge members of the wall element forming the engaging surface are formed from component parts of the wall elements provided, with the longer bridge members provided between the shorter bridge members having their free ends configured in a protruding fashion relative to at least one angled wall element. This embodiment enables, for example, the wall thickness of the outer cutter engaging surface to be reduced in conformity with the requisite stability of the outer cutter, enabling, in consequence, the hairs to be cut close to the skin.

A further embodiment of the present invention is characterized in that the outer cutter engaging surface which is increased by means of the protruding hair-feeding means is of an essentially planar configuration.

According to the present invention, a guided entry of hairs into the cutting area in a manner which is particularly gentle on the skin is ensured in that at least the edges of the bridge members contacting the skin as well as the edges of the hair-feeding means are of a rounded configuration.

In a particularly advantageous embodiment of the present invention, the outer cutter is of a U-shaped configuration, and the hair-feeding means, as component parts of the bridge members of the wall element forming the engaging surface, are provided such as to protrude relative to the outer contour of at least one wall element arranged at an angle thereto.

In another embodiment of the present invention, the outer cutter is of a cup-shaped configuration, and the hair-feeding means, as component parts of the bridge members of the wall element forming the engaging surface, are configured such as to protrude relative to the outer contour of the annular wall element and/or a further annular wall element.

A further embodiment of the present invention enhancing the stability of the outer cutter is characterized in that the bridge members of the engaging surface which are formed by slots are mutually connected by means of connecting bridge members.

Further essential advantages will become apparent from the various fields of application of the present invention. In an embodiment of the present invention, the hair-feeding means are provided on the outer cutter of a shaving head configured as a short-hair cutter unit. Outer cutters of this type are of a cup-shaped configuration, having cutting ledges formed by slots and utilized according to the invention for the formation of hair-feeding means.

In a further embodiment of the present invention, the hair-feeding means are provided on the outer cutter of a shaving head configured as a long-hair cutter unit. Outer cutters of this type are preferably of a U-shaped configuration, having cutting ledges formed by slots and utilized according to the invention for the formation of hair-feeding means.

In a preferred embodiment of the present invention, the shaving head configured as a long-hair cutter unit provided with hair-feeding means is disposed between two shaving heads configured as short-hair cutter units, and the hair-feeding means are provided on the outer cutter of the long-hair cutter unit adjacent to the respective outer cutters of the short-hair cutter units. This embodiment affords a very essential advantage because the hair-feeding means provided on the outer cutter of the long-hair cutter unit adjacent to the respective outer cutter of the short-hair cutter units operate in alternation, in dependence on the direction in which the shaving heads are moved across the skin to be shaved, in order to feed the longer hairs into the cutting area of the long-hair cutter unit to perform a cutting action. After the longer hairs are cut and as the shaving heads continue their movement across the skin, the remaining length of hair is fed to the respective cutting area of the adjacent short-hair cutter unit for a still closer cut.

In another embodiment of the present invention, the shaving head provided with hair-feeding means is arranged so as to be movable in a vertical direction (direction of arrow A) relative to at least one of the shaving heads configured as short-hair cutter units.

BRIEF DESCRIPTION OF THE DRAWINGS

Preferred embodiments of the present invention will be described in more detail in the following with reference to the accompanying drawings. In the drawings.

DESCRIPTION OF THE PREFERRED EMBODIMENT

Figure 1:
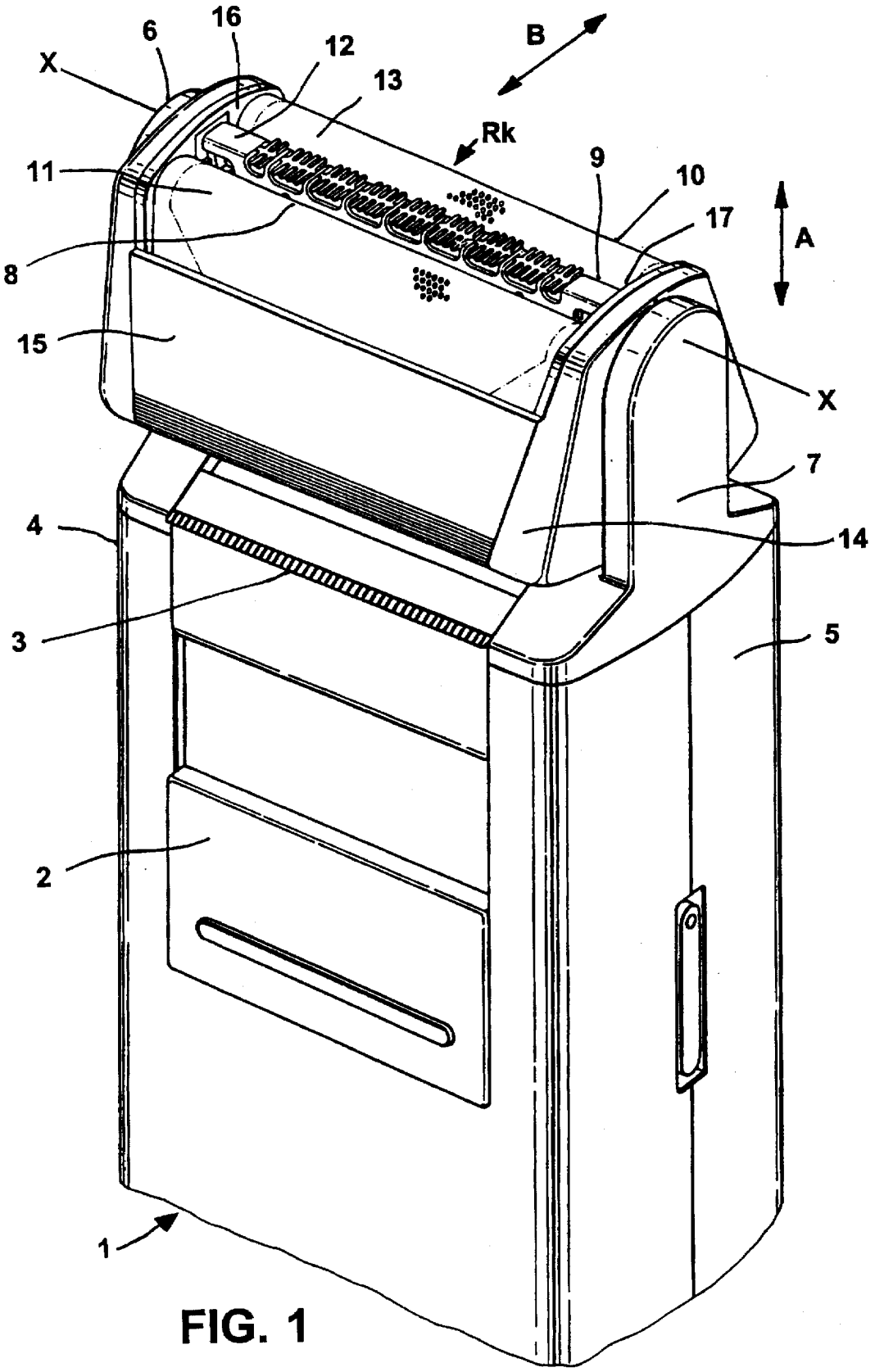
FIG. 1 is a perspective view of part of a dry shaving apparatus having three shaving heads.

Referring now to FIG. 1 showing the upper portion of an electric dry shaving apparatus, reference numeral 1 identifies a housing, reference numeral 2 an On/Off switch, 3 a long-hair trimmer unit provided with cutting teeth, numerals 6 and 7 designate support lugs forming an extension of narrow end walls 4 and 5 of the housing, and RK identifies a shaver head assembly mounted on the support lugs 6, 7 so as to be pivotal about an axis x—x.

Figure 2A:
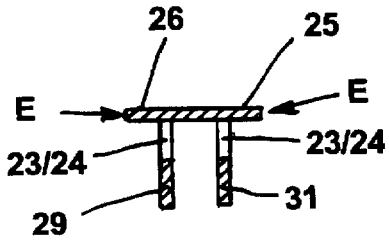
FIG. 2*a* is a sectional view of the U-shaped profile of an outer cutter provided with hair-feeding means.

The shaver head assembly RK incorporates three shaving heads 8, 9 and 10 extending parallel to each other, whereof the two outer shaving heads 8 and 10 are configured as short-hair cutter units, while the shaving head 9 arranged between the shaving heads 8 and 10 is configured as a long-hair cutter unit. The outer cutters 11 and 13 of the shaving heads 8 and 10 forming the short-hair cutter units are fixed to an exchangeable frame 15 detachably arranged on the shaver head frame 14. As illustrated and described with reference to FIG. 2 and FIG. 2*a*, the outer cutter 12 of the shaving head 9 forms part of an assembly comprised of outer cutter 12, an inner cutter 18, a pressure spring 19, and a connecting member 20 for transmitting a driving motion. Forming the shaving head 9 of the long-hair cutter unit, this assembly is mounted on end walls 16 and 17 of the exchangeable frame 15 either in an immovable or a vertically movable manner—see direction of arrow A.

In a further embodiment, the outer cutter 12 of the shaving head 9 may be immovably secured directly to the end walls 16 and 17 of the exchangeable frame 15 or a shaver head frame carrying or encompassing the shaving heads or, alternatively, it may be arranged to be relatively movable in a vertical direction—see direction of arrow A. In such an embodiment, the inner cutter 18 necessary for the cutting operation is coupled to the drive mechanism of the electric dry shaving apparatus by means of a connecting member 20 and is urged into engagement with the outer cutter 12 by a pressure spring 19.

Figure 1A:
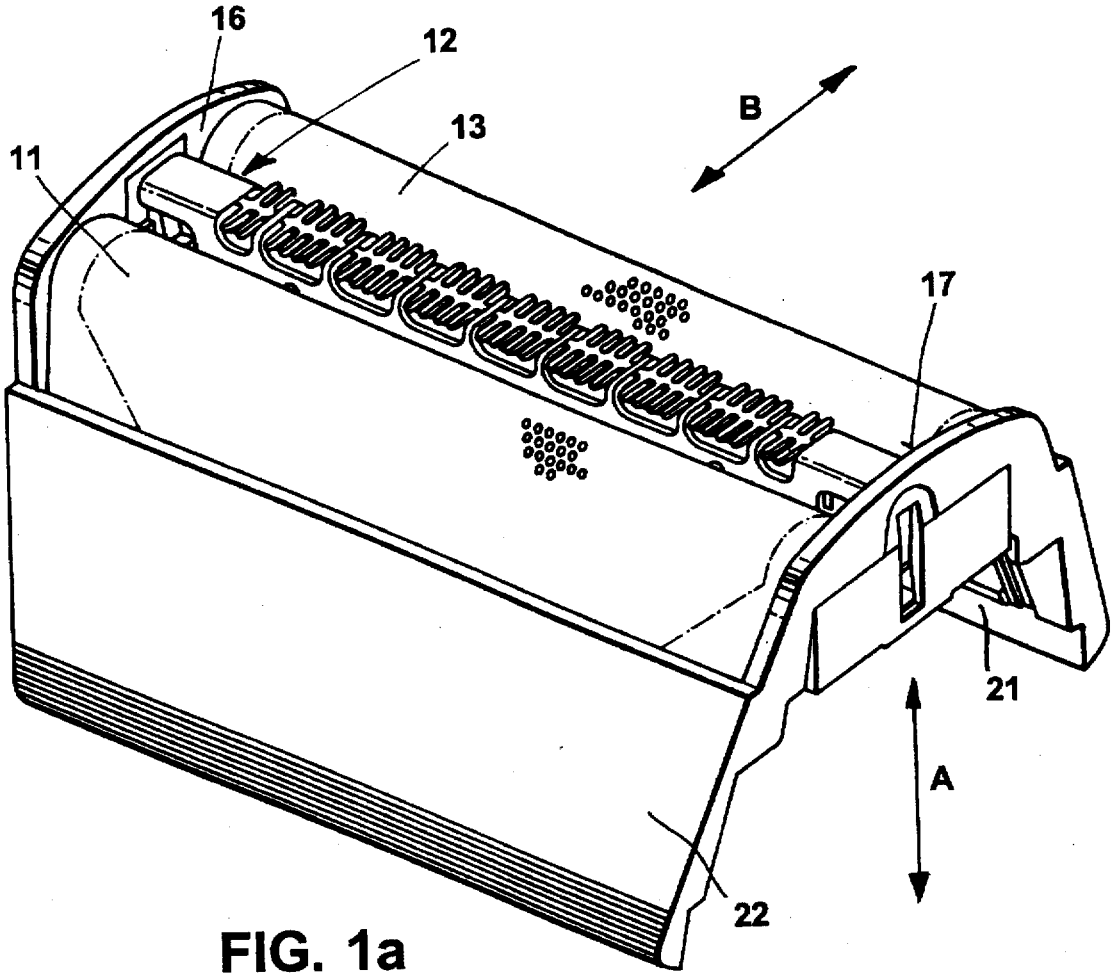
FIG. 1*a* is a perspective view of an exchangeable frame structure having outer cutters configured in different fashions.

Further details of an exchangeable frame 15 in detached condition from the shaver head frame 14 of FIG. 1 are illustrated in FIG. 1*a* and will be described in more detail in the following. The shaving foils attached in arched form and providing the outer cutters 11 and 13 for cutting short hair are mounted on respective longitudinally extending side walls 21 and 22 of the exchangeable frame 15 as well as on rib members, not shown, provided between the end walls 16, 17. The U-shaped outer cutter 12 of the shaving head 9 provided for cutting long hair is vertically movably mounted—see direction of arrow A—on the end walls 16 and 17. In this embodiment, the outer cutter 12 is a sheet metal part in which there are formed, as by stamping, a plurality of slots 23 and further slots 24 extending in the longitudinal direction of the outer cutter 12 and partially connecting the slots 23, with bridge members 25, 26, 27, 28 being formed therebetween. Applying a pressing method, the sheet metal member is subsequently pressed into a U-shape, such that the bridge members 25, 26 extending transversely to the longitudinal direction of the outer cutter 12 protrude beyond the outer contour of the two wall elements 29 and 31 extending in an angled relationship to the wall element 30—see sectional view of FIG. 2*a*.

The portions of the bridge members 25, 26 that protrude relative to the wall elements 29, 31 act as hair-feeding means E, feeding the hairs into the cutting area of the outer cutter 12.

Figure 2:
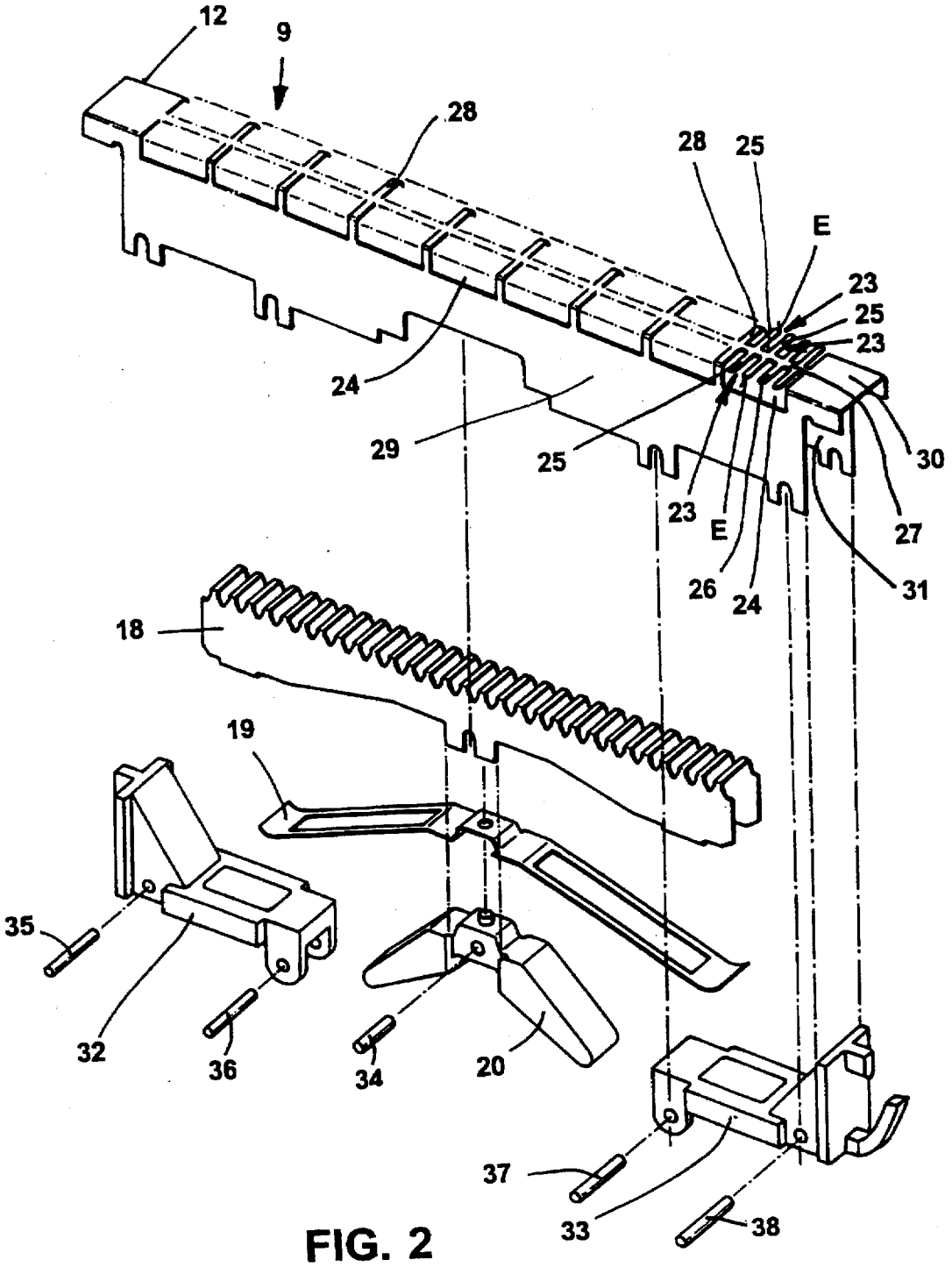
FIG. 2 is an exploded view of components of a shaving head configured as a long-hair cutter unit.

Moreover, in the embodiment illustrated in FIG. 2, the relative arrangement and shaping of the slots 23 and 24 are such that in the wall element 30 a bridge member 27 extending in the longitudinal direction of the outer cutter 12 is formed, in addition to forming several further bridge members 28 extending transversely to the bridge member 27 and shaped to conform to the U-shape of the outer cutter 12. The number of bridge members 28 provided depends on the stability of the outer cutter 12 required for the particular application and is accordingly not limited to the number illustrated in FIG. 2. In the embodiment shown in FIG. 2, between each two bridge members 28 there are provided on either side of the bridge member 27 four bridge members 25 and 26 each which perform a cutting function in the area of the oscillating inner cutter 18 engaging the outer cutter 12 under the action of the pressure spring 19 and, in their capacity as hair-feeding means E, perform a hair-engaging function with their ends protruding relative to the angled wall elements 29 and 31 as the outer cutter 12 is moved across the skin surface. To avoid irritation to the skin, the edges of the bridge members 25 to 28 contacting the skin, in particular the edges of the hair-feeding means E formed by the bridge members 25 and 26, are rounded. The number of bridge members 25, 26 between each two bridge members 28 is variable, making allowance for the requisite stability of the outer cutter 12. In combination with a hair-feeding operation performed by the hair-feeding means E of the bridge members 25 and 26, the slots 24 defined in the wall elements 29 and 31 by the respective bridge members 28 enable longer hairs to enter readily the cutting area of the shaving head 9 configured as a long-hair cutter unit.

To assemble the shaving head 9 of FIG. 2 to a complete unit, the pressure spring 19 is coupled to the connecting member 20. Then the inner cutter 18 is secured to the connecting member 20 by means of a pin 34 and introduced into the interior of the U-shaped outer cutter 12. By means of the two mounting members 32, 33 which are brought into abutting engagement with respective ends of the pressure spring 19, thus serving a supporting function for this particular spring, the inner cutter 18, the pressure spring 19 and the connecting member 20 are combined with the outer cutter 12 to form an assembly held together by pins 35 to 38 passed through the mounting members 32, 33 to be firmly fixed to the wall elements 29 and 31 of the outer cutter 12 as by welding. This unit which is preassembled to form a complete shaving head 9 is subsequently attached to the end walls 16 and 17 of the exchangeable frame 15—see FIGS. 1 and 2—or, alternatively, is mounted so as to be vertically movable in the direction of arrow A.

By virtue of the combined arrangement of two shaving heads 8 and 10 of FIGS. 1 and 1*a* configured as short-hair cutter units with a shaving head 9 of FIG. 2 disposed between these shaving heads 8 and 10 and configured as a long-hair cutter unit, it is ensured, in particular as the shaver head assembly RK is moved in the direction of arrows B, that long hairs are fed into the cutting area of the shaving head 9 without causing irritation to the skin, followed immediately by a short-hair cut performed by the adjacent shaving head 8 or 10. By means of a movable bearing structure of the shaving head 9 in the exchangeable frame 15 or in a shaver head frame—not shown—, it is possible to achieve a so-called bow-wave effect on the skin enhancing both the catching, the guided entry, the cutting of long hairs, and the subsequent cutting of short hairs.

Figure 3:
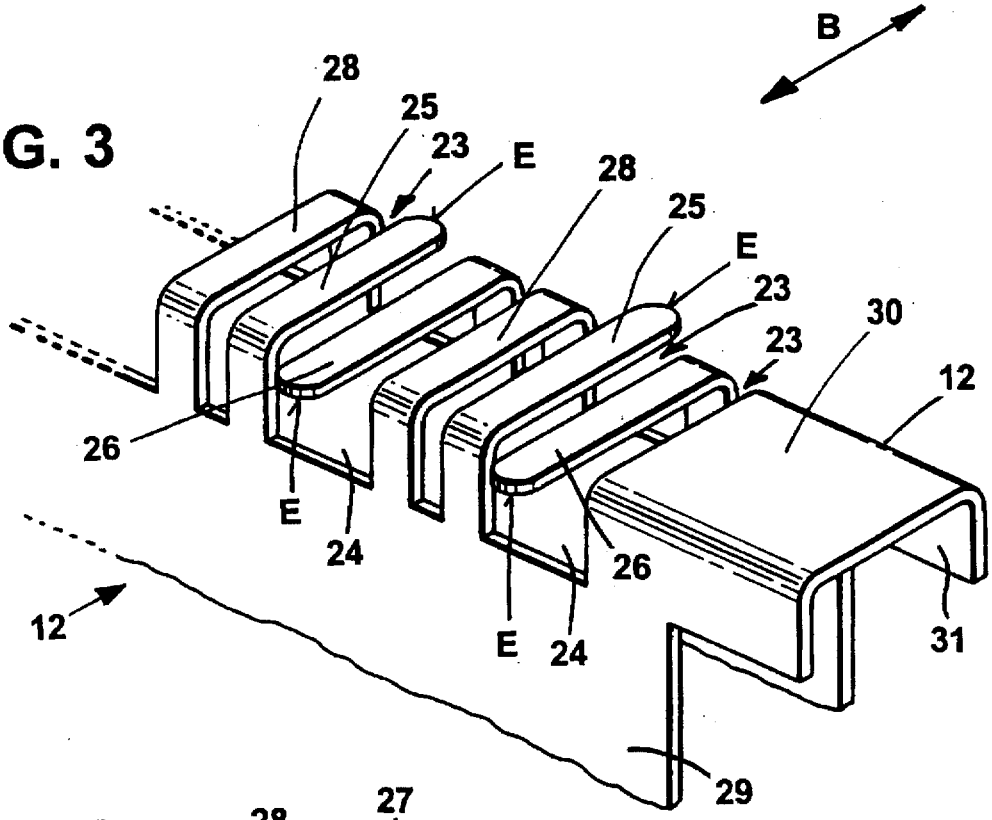
FIG. 3 is a fragmentary perspective view of a U-shaped outer cutter provided with hair-feeding means.

FIG. 3 shows a further embodiment of an outer cutter 12 with hair-feeding means E projecting beyond the contour of the wall elements 29, 31 and forming part of the bridge members 25, 26. The L-shaped bridge members 25, 26 as well as the U-shaped bridge members 28 are part of the wall elements 29, 30, 31, being formed by the provision of fully penetrating slots 23 and 24 in the wall elements 29, 30, 31. To ensure the guided entry of long hairs in either direction of movement as indicated by arrow B, the bridge members 25 with their rounded hair-feeding means E are arranged on the outer cutter 12 in opposed relationship to the bridge members 26 with their hair-feeding means E. The upper side of the bridge members 25 and 28 or of the respective component part of the wall element 30 represents the skin engaging surface of a shaving head 9 equipped with such an outer cutter 12.

Figure 4:
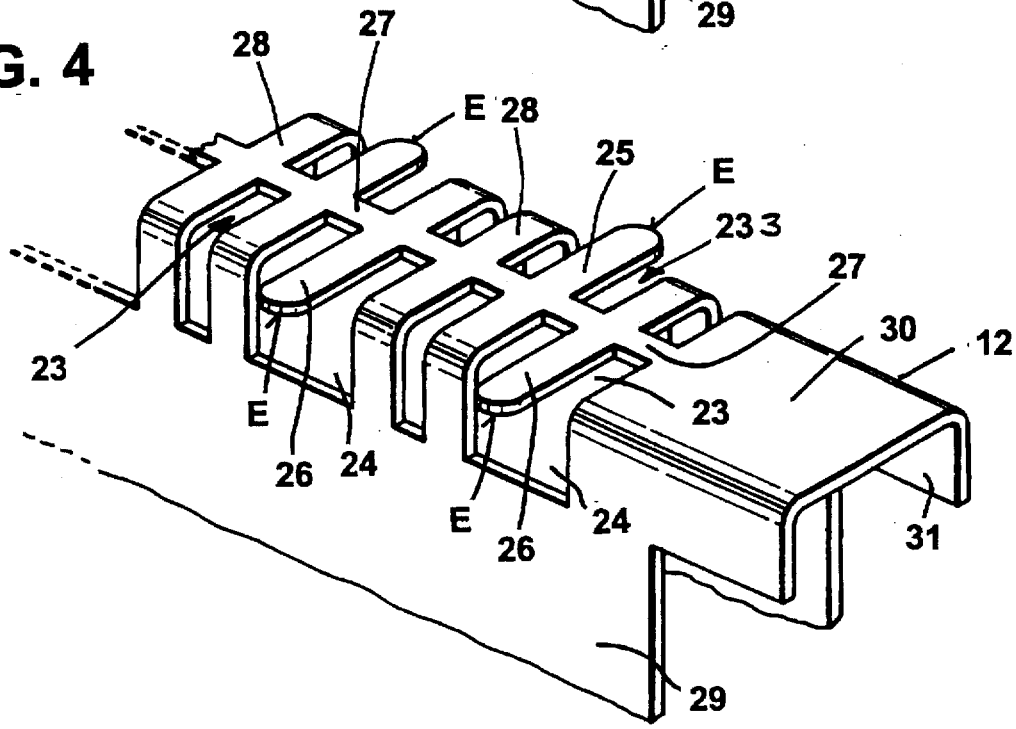
FIG. 4 is a fragmentary perspective view of a U-shaped outer cutter provided with hair-feeding means.

FIG. 4 illustrates still another embodiment of an outer cutter 12 with hair-feeding means E projecting beyond the contour of the wall elements 29, 31 and forming part of the bridge members 25, 26. Alignment and arrangement of the bridge members 25, 26 and 28 correspond essentially to the embodiment of FIG. 3, except that the bridge members 25, 26 and 28 performing a hair-feeding and cutting function are connected with each other by a bridge member 27 extending in the longitudinal direction of the outer cutter 12. The bridge member 27 adds to the stability of the U-shaped profile.

Figure 5:
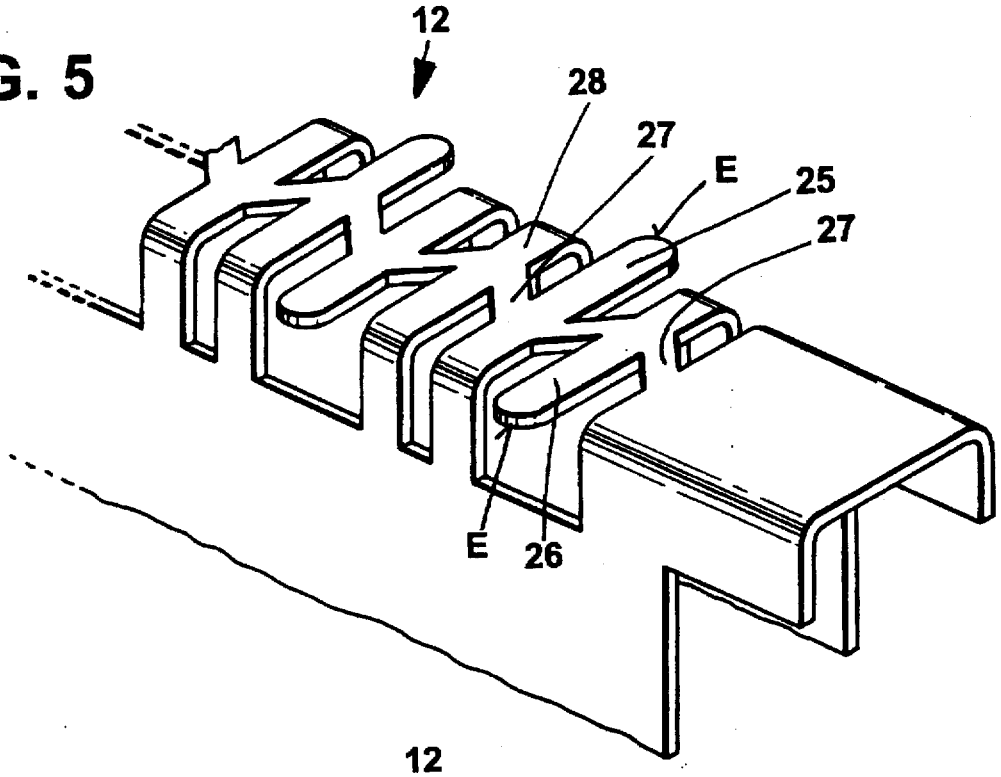
FIG. 5 is a fragmentary perspective view of a U-shaped outer cutter provided with hair-feeding means.

FIG. 5 shows a still further embodiment of a U-shaped outer cutter 12 in which, other than in the embodiment of FIG. 4, the bridge members 25, 26, 28 are mutually connected by bridge members 27 that extend obliquely to the longitudinal direction of the outer cutter 12.

Figure 6:
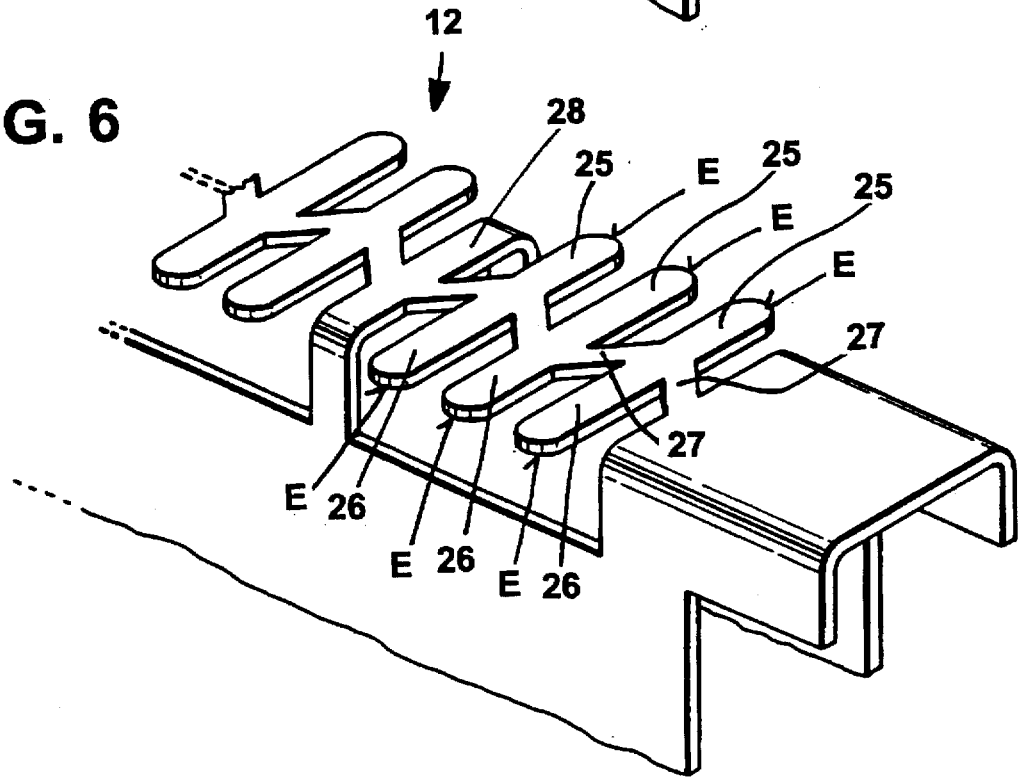
FIG. 6 is a fragmentary perspective view of a U-shaped outer cutter provided with hair-feeding means.

FIG. 6 shows a further embodiment of a U-shaped outer cutter 12 in which the comb geometry of the bridge members 25, 26, 28 performing a hair feeding and cutting function is configured such that a continuous bridge member composed of bridge members 27 has on either side thereof, transversely to the longitudinal direction of the outer cutter 12, bridge members 25, 26 that are provided with hair-feeding means E and project beyond the contour of the U-profile. The number of bridge members 25, 26 to be provided between each two bridge members 28 conforming to the U-profile of the outer cutter 12 is variable, being not limited to the three parallel bridge members 25, 26 as illustrated in FIG. 6.

Figure 7:
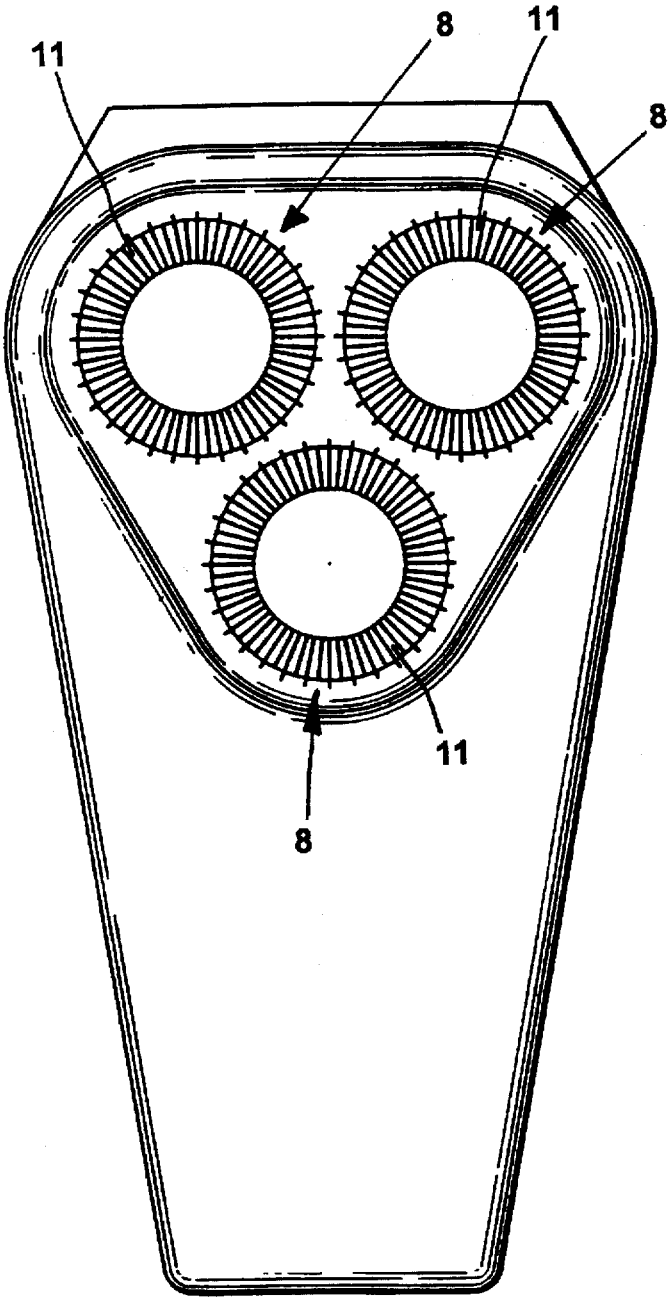
FIG. 7 is a side view of a shaving apparatus having three circular-ring-shaped outer cutters provided with hair-feeding means.
Figure 8:
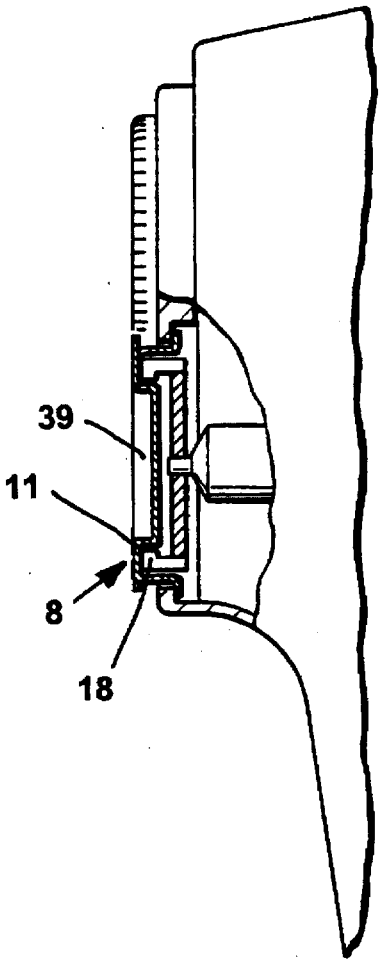
FIG. 8 is a partial sectional view of the shaving head as well as of a cup-shaped outer cutter provided with hair-feeding means of the shaving apparatus of FIG. 7.

FIG. 7 shows a shaving apparatus having three shaving heads 8 comprising each an outer cutter 11 and an inner cutter 18—see FIG. 8. The outer cutter 11 of the shaving heads 8 is of a cup-shaped configuration—see FIGS. 8 to 11—resulting in a planar wall element 30 and a circular-ring-shaped wall element 31 arranged at an angle thereto. For the purpose of providing a circular-ring-shaped cutting area, the wall element 30 has in its center a cup-shaped recess 39 whose wall elements are identified by reference numerals 29 and 40. The bridge members 25, 26, 28 performing a cutting function are formed by a plurality of slots 23 penetrating fully the wall element 30 in the circular-ring-shaped cutting area, while penetrating in part the circular-ring-shaped wall element 31 arranged at an angle thereto. In order to obtain bridge members 26 that protrude relative to the angled wall element 31—see FIG. 9—and bridge members 25 that protrude relative to the wall element 29—see FIGS. 10 and 11—, with the protruding portions thereof acting as hair-feeding means E for the guided entry of hair, first at least two slots 23 provided on either side of a bridge member 26 are mutually connected by means of a slot 24 provided in the wall element 31—see FIG. 9—, and at least two slots 23 provided on either side of a bridge member 25 are mutually connected by a slot 24 provided in the wall element 29—see FIGS. 10 and 11. Then the wall portion of the angled wall element 31 (FIG. 9) provided on the bridge member 26 and the wall portion of the angled wall element 29 provided on the bridge member 25 are forced into a plane with the skin-engaging surface of the wall element 30 of the outer cutter 11 as by pressing—see FIGS. 9 and 10.

Figure 9:
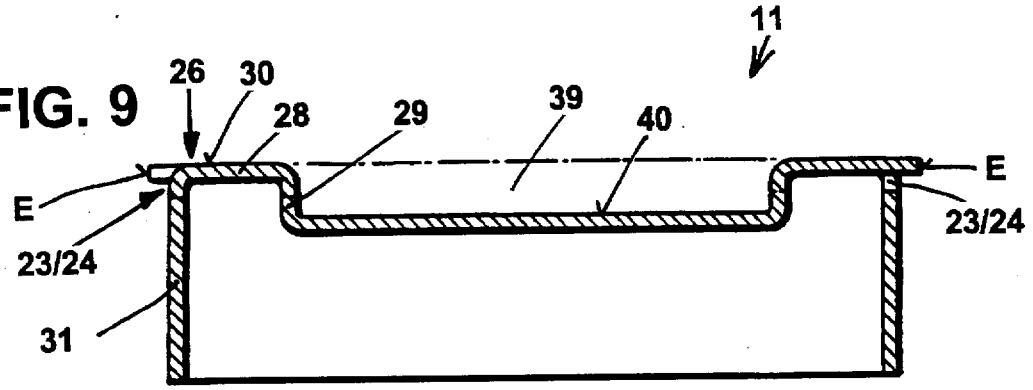
FIG. 9 is a sectional view of a cup-shaped outer cutter provided with hair-feeding means.

The embodiment of FIG. 9 presents a combination of bridge members 26 and 28, in which the hair-feeding means E as a component part of the bridge members 26 are arranged to protrude relative to the angled wall element, while the bridge members 28 are formed by the wall elements 29, 30, 31. The number of bridge members 26 with hair-feeding means E that may be provided between each two bridge members 28 is freely selectable.

Figure 10:
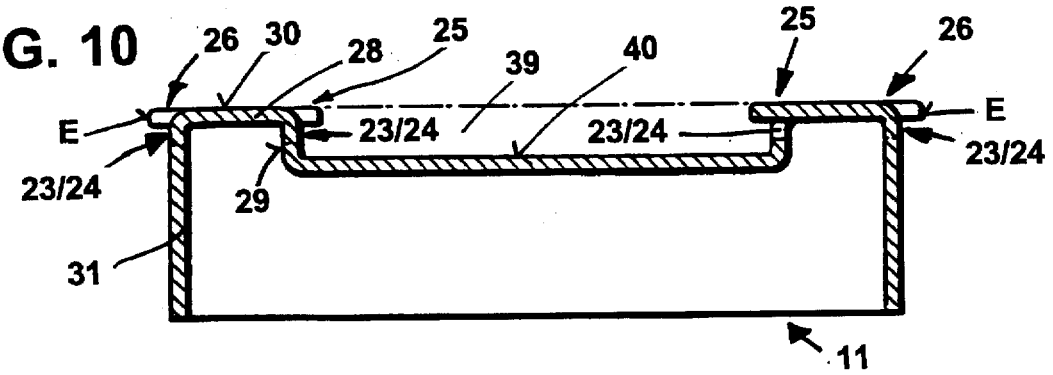
FIG. 10 is a sectional view of a cup-shaped outer cutter provided with hair-feeding means.
Figure 11:
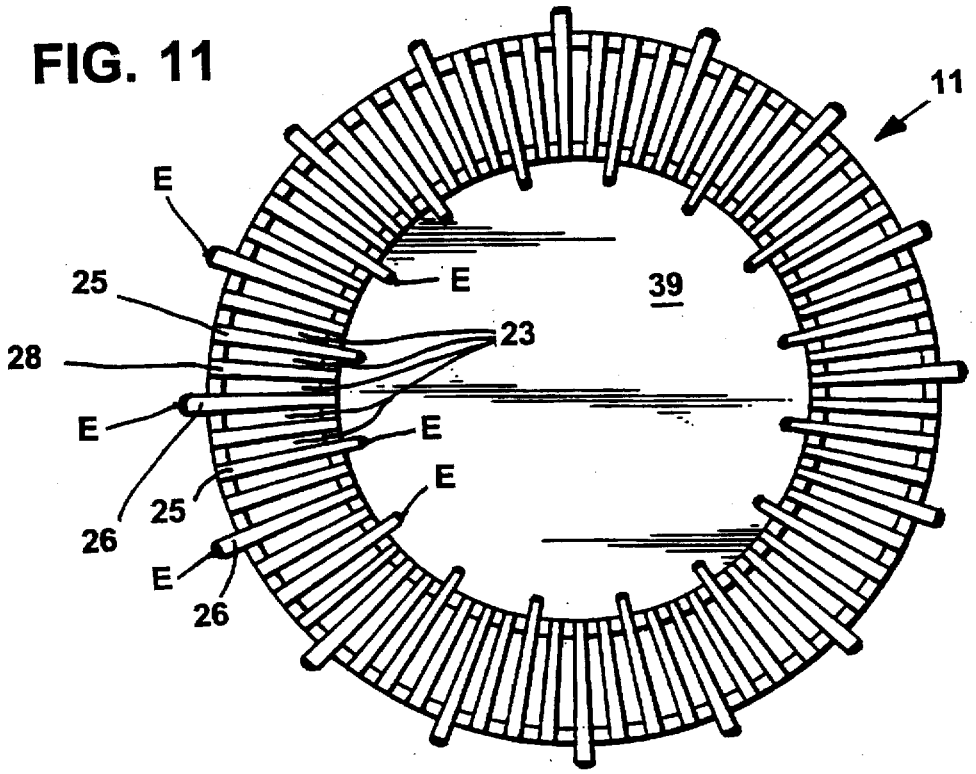
FIG. 11 is a top plan view of the upper side of the cup-shaped outer cutter of FIG. 10.

The embodiment of FIGS. 10 and 11 presents a combination of bridge members 25, 26 and 28. The bridge members 26 and 25 having hair-feeding means E are of a protruding configuration relative to the wall element 31 and 29, respectively, and, in consequence, are used alternately during the shaving operation in dependence on the direction of movement of the shaving head 8 across the skin surface, in order to feed both longer and shorter hairs into the cutting area formed by the bridge members 25, 26 of the outer cutters 11 and the inner cutters 18 operatively associated therewith—see FIG. 8. The bridge members 28 formed by the wall elements 29, 30, 31 provide the outer cutter 11 with the requisite stability. It will be understood that the number and the type of arrangement of the bridge members 25 and 26 with hair-feeding means E that may be provided between each two bridge members 28 are not limited to the embodiment illustrated in FIG. 11. The embodiments illustrated in FIGS. 2, 3, 4, 5 and 6 by way of example are equally applicable to an outer cutter 11 used in a shaving apparatus constructed in accordance with FIGS. 7 and 8.

I claim:

1. A shaving head, comprising:

an outer cutter including a surface for engaging a user's skin, said surface having a plurality of slots and bridge members lying substantially in a plane, said outer cutter including a first wall element and a second wall element disposed in an angled relationship to and extending down from said surface, at least a portion of said bridge members having at least one end projecting freely relative to and protruding beyond one of said first and said second wall elements, said at least one end defining an outer extremity of said outer cutter, and an inner cutter positioned between said first and said second wall elements.

2. The shaving head of claim 1 wherein said portion of said bridge members has said one first end projecting freely relative to and protruding beyond said first wall element and a second end projecting freely relative to and protruding beyond said second wall element.

3. The shaving head of claim 1 wherein said bridge members include longer bridge elements defining said portion of said bridge members having said at least one end projecting freely relative to and protruding beyond one of said first and said second wall elements, and said bridge members include shorter bridge elements having ends terminating at said first and said second wall elements.

4. The shaving head of claim 1 wherein said bridge members define rounded side and end edges.

5. The shaving head of claim 1 wherein said surface and said first and said second wall elements form a u-shaped outer cutter.

6. The shaving head of claim 1 wherein said first and said second wall elements are of annular shape.

7. The shaving head of claim 1 further including connecting members connecting said bridge members.

8. The shaving head of claim 1 wherein said shaving head is configured as a short-hair cutter.

9. The shaving head of claim 1 wherein said shaving head is configured as a long-hair cutter.

10. A dry shaving apparatus, comprising:

a first shaving head including an inner cutter and an outer cutter, said outer cutter including a surface for engaging a user's skin, said surface having a plurality of slots and bridge members lying substantially in a plane, said outer cutter including a first wall element and a second wall element disposed in an angled relationship to and extending down from said surface, at least a portion of said bridge members having at least one end projecting freely relative to and protruding beyond one of said first and said second wall elements, and said inner cutter being positioned between said first and said second wall elements, said first shaving head being configured as a long-hair cutter, and a first and a second short-hair shaving heads, said long-hair cutter being positioned between said first and said second short-hair shaving heads.

11. The dry shaving apparatus of claim 10 wherein said long-hair cutter is movable in a vertical direction relative to at least one of said first and said second short-hair shaving heads.

12. A shaving head, comprising:

an outer cutter and an inner cutter, said outer cutter including a surface for engaging a user's skin, said surface having a plurality of slots and bridge members lying substantially in a plane, said outer cutter including a first wall element and a second wall element disposed in an angled relationship to and extending down from said surface, said bridge members including longer bridge members having at least one end projecting freely relative to and protruding beyond one of said first and said second wall elements, and shorter bridge members having ends terminating at said first and said second wall elements.

13. A shaving head, comprising:

an outer cutter including a surface for engaging a user's skin, said surface having a plurality of slots and bridge members lying substantially in a plane, and an annular wall element disposed in an angled relationship to and extending down from said surface, at least a portion of said bridge members having an end projecting freely relative to and protruding in an outward radial direction beyond said annular wall element, and an annular inner cutter positioned next to and radially inside said annular wall element.

14. A shaving head, comprising:

an outer cutter including a surface for engaging a user's skin, said surface having a plurality of slots and bridge members lying substantially in a plane, said outer cutter including a first wall element and a second wall element disposed in an angled relationship to and extending down from said surface, at least a portion of said bridge members having at least one end projecting freely relative to and protruding beyond one of said first and said second wall elements, said bridge members include longer bridge elements defining said portion of said bridge members having said at least one end projecting freely relative to and protruding beyond one of said first and said second wall elements, and said bridge members include shorter bridge elements having ends terminating at said first and said second wall elements, and an inner cutter positioned between said first and said second wall elements.

15. A shaving head, comprising:

an outer cutter including a surface for engaging a user's skin, said surface having a plurality of slots and bridge members lying substantially in a plane, said outer cutter including a first wall element and a second wall element disposed in an angled relationship to and extending down from said surface, said first and said second wall elements being of annular shape, at least a portion of said bridge members having at least one end projecting freely relative to and protruding beyond one of said first and said second wall elements, and an inner cutter positioned between said first and said second wall elements.

* * * * *

UNITED STATES PATENT AND TRADEMARK OFFICE

CERTIFICATE OF CORRECTION

PATENT NO. : 5,669,138

DATED : September 23, 1997

INVENTOR(S) : Matthias Wetzel

It is certified that error appears in the above-identified patent and that said Letters Patent is hereby corrected as shown below:

On the title page, item[56]:

In [56], References Cited, U.S. Patent Documents, insert --4,393,586 7/1983 Hamashima et al. 30/43.6--.

Col. 7, l. 55, delete "first".

Signed and Sealed this

Twenty-ninth Day of June, 1999

*Attest:*

*Attesting Officer*

Q. TODD DICKINSON

*Acting Commissioner of Patents and Trademarks*